United States Patent [19]

Krystyniak

[11] 4,222,330

[45] Sep. 16, 1980

[54] MAGNETICALLY TAGGING AMMUNITION CARTRIDGES

[75] Inventor: Casimir W. Krystyniak, Schenectady, N.Y.

[73] Assignee: General Electric Company, Schenectady, N.Y.

[21] Appl. No.: 934,166

[22] Filed: Aug. 16, 1978

[51] Int. Cl.[3] ..... F42B 5/02

[52] U.S. Cl. ..... 102/38 R; 102/92.1; 149/2

[58] Field of Search ..... 102/38 R, 92.1–92.7, 102/49.5, 27; 149/2 T

[56] References Cited

U.S. PATENT DOCUMENTS

| | | | |
|---|---|---|---|
| 1,275,669 | 8/1918 | Forbes | 102/92.7 |
| 1,650,908 | 11/1927 | Ramsey | 102/38 R |
| 3,736,500 | 5/1973 | Berkowitz . | |
| 3,772,200 | 11/1973 | Livesay | 149/2 T |
| 4,131,064 | 12/1978 | Ryan | 149/2 T |
| 4,150,624 | 4/1979 | Hammond | 102/38 R |

*Primary Examiner*—Harold J. Tudor

*Attorney, Agent, or Firm*—Alexander M. Gerasimow; James C. Davis; Marvin Snyder

[57] ABSTRACT

Magnetic particles, particularly ferrites, exhibiting a plurality of distinct Curie temperatures are disposed within standard center-fire or rimfire cartridge ammunition to provide a method for identifying cartridges. In one embodiment, magnetic particles are disposed within the projectile portion of the cartridge; in another embodiment, the magnetic particles are disposed within the primer of the cartridge; and in still another embodiment, magnetic tagging particles are disposed on or about the cartridge casing.

17 Claims, 2 Drawing Figures

MAGNETICALLY TAGGING AMMUNITION CARTRIDGES

BACKGROUND OF THE INVENTION

This invention relates to magnetic tags, and more specifically to ammunition cartridges in which magnetic tags are exposed for purposes of identification.

Present day cartridge cartridge ammunition for rifles and pistols, particularly for civilian use, is of two basic types: center-fire and rimfire. Both types typically possess a projectile portion which is streamlined for aerodynamic reasons and typically comprises a soft metal such as lead, a lead based alloy or cladded lead composite. The projectile portion is fitted into a casing portion which is typically brass. An explosive material, such as smokeless gunpower, is disposed within the casing and sealed therein by the projectile portion of the cartridge. Additionally, in center-fire ammunition there is disposed a primer located at the end of the casing opposite the open end into which the projectile is fitted. The primer comprises a primer case and a primer esplosive which is typically detonated by the impact of a firing pin on the primer case. Thus, in center-fire ammunition cartridges, the detonation of the primer acts to detonate the main explosive powder charge which accelerates the projectile along the barrel of the rifle or pistol into which the cartridge has been inserted. Rimfire ammunition cartridges work in the same way except that the primer explosive is not centrally located and typically is not disposed in its own casing.

In its passage through the barrel of the weapon employed, the projectile is usually impressed with markings (rifling) which can be used to match the projectile, when recovered, with the weapon from which it was fired. Police and other investigative agencies have long used this method of identification to match a projectile with the owner or user of the weapon from which it was fired. Other than this, there is no other significant means of identification in use.

It is highly desirable to have a method for more directly associating the projectile, the casing, or the entire cartridge with an individual user or purchaser. At present, a cartridge or the casing may be traceable to a given manufacturer, assuming he has placed his name or trademark thereon. However, it is not now possible to identify the projectile or casing by lot number, point of sale, distributor, shift of manufacture, type of main explosive charge, type of primer, amount of explosive charge, or other relevant identifying characteristic. Such information is very valuable to ballistics experts and crime prevention agencies.

SUMMARY OF THE INVENTION

In accordance with a preferred embodiment of the present invention, magnetic particles, such as ferrites, exhibiting at least one Curie temperature, are disposed in an ammunition cartridge. The magnetic particles may be disposed in the projectile, in the primer explosive, in the main explosive charge on the casing, or in any combination thereof. The presence or absence of any given Curie temperature determines the particular tag code present. Different, similar, or identical tag codes may be employed in the projectile, the main explosive charge, the primer and the casing. The codes may be established to identify a number of relevant characteristics such as manufacture and point of sale or other characteristics such as those mentioned above.

Accordingly, it is the object of the present invention to provide magnetically tagged ammunition cartridges to better enable investigative agencies to identify relevant characteristics associated with the cartridge.

DETAILED DESCRIPTION OF THE INVENTION

Figure 1:
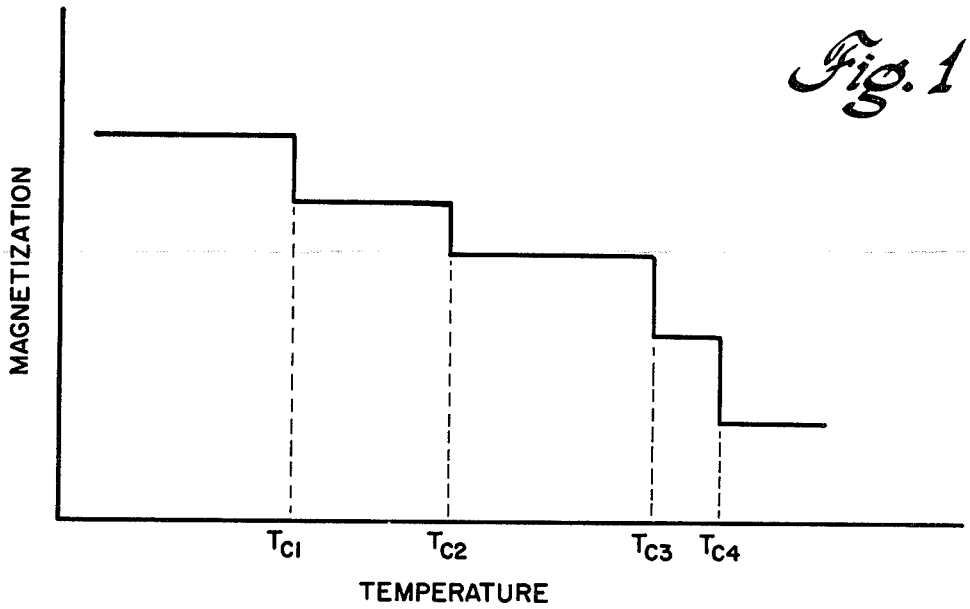
FIG. 1 is a graph of magnetization versus temperature for magnetic tagging material comprising ferrites having four distinct Curie temperatures.

FIG. 1 illustrates the concept underlying magnetic tagging. FIG. 1 is a graph of magnetization versus temperature for a sample magnetic tag comprising a plurality of ferrites with four distinct Curie temperatures $T_{C1}$, $T_{C2}$, $T_{C3}$, and $T_{C4}$. As the sample of material is heated, the magnetization is observed to decrease at certain temperatures. The transition is not necessarily as precipitous as FIG. 1 might imply for the scales chosen. The decrease in magnetization is in actuality relatively smooth but the transitions in FIG. 1 are depicted as sharp for ease of understanding. Nonetheless, by observing the curve at points of inflection the Curie temperatures present in the tag are readily discernible. Moreover, the determination of Curie temperature is a repeatable measurement which can be made as often as desired as long as the ferrite is not heated to temperatures at which the ferrite structure and composition are changed. As long as the heating is thus controlled, measurement of the Curie temperature of even a single ferrite particle of sufficient size is possible.

In a limited number of applications, a tag exhibiting only a single Curie temperature may be required. However, the tagging system of the present invention typically employs tags exhibiting a plurality of Curie temperatures. As discussed below, ferrite materials exhibiting Curie temperatures from below 0° C. to temperatures in excess of 500° C. are useable. In this temperature range, as many as 40 or 50 ferrites, each possessing a distinct Curie temperature, may be employed. For example, if there are 50 such Curie temperatures to choose from, and any five of these are chosen to form a particular tag code, then a total of 2,118,760 distinct tag codes are possible. If desired, this number may be increased by increasing the number of distinct Curie temperatures selected. The use of ferrites with up to approximately 50 distinct Curie temperatures is accomplished by employing an average resolution of approximately 10° C. between adjacent Curie temperatures. This resolution is well within the capabilities of existing measuring instruments. If desired, the resolution may be changed to 15° C. between adjacent Curie temperatures at the expense of lowering the number of useable tag codes.

Figure 2:
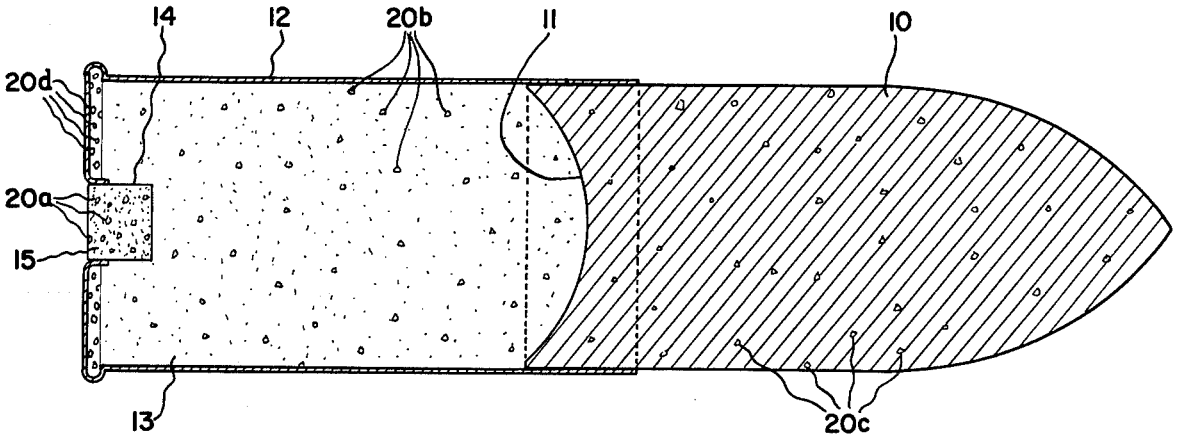
FIG. 2 is a cross-sectional side view of an ammunition cartridge having magnetic particles disposed therein in accordance with a preferred embodiment of the present invention.

FIG. 2 illustrates a preferred embodiment of the present invention. The cartridge shown comprises projectile 10, casing 12, explosive material 13, primer case 14 and primer explosive 15. A center-fire cartridge is shown. However, a rim fire cartridge is substantially the same in appearance except that primer case 14 and primer 15 are not present and there is no corresponding provision made therefor in casing 12. The projectile 10 may comprise lead or a lead-based alloy or as is more conventionally the case, the projectile 10 is a copper cup filled with lead and formed into a conical shape. The projectile typically possesses an indented region 11 at the end of the projectile which is inserted into the casing 12. The casing 12 is typically brass, although in the case of shotgun shells, the casing may comprise a combination of a brass base with plastic or heavy paper cylindrical sides. The main explosive charge material 13 is typically a rapid burning smokeless gunpowder selected to accelerate the projectile 10 to high velocity upon detonation. Center-fire ammunition typically also possesses a primer comprising primer case 14 and primer explosive 15. The primer case is typically centrally located and disposed in the casing 12 at an end opposite to the open end into which the projectile 10 is fitted. The primer explosive itself is chosen to be sensitive to mechanical shock such as that delivered by refiring pin of a rifle or pistol.

In accordance with the present invention, magnetic particles, such as ferrites, are disposed within the cartridge. For example, in one embodiment, ferrite particles 20*a* are mixed in with the primer explosive 15 within the primer case 14 which is typically a soft non-magnetic metal. In accordance with another embodiment of the present invention ferrite particles 20*b* are mixed with the main explosive charge 13 which is typically a powder. Thus the magnetic tagging of the primer and main explosive charge is readily accomplished simply by mixing with ferrite particles exhibiting the Curie temperatures corresponding to an assigned tag code. The ferrite particles used are typically between 1 and 10 microns in diameter.

In yet another embodiment of the present invention, the ferrite particles are disposed throughout the projectile 10. This is typically accomplished by mixing the ferrite particles with molten lead or other low melting point alloy. In this embodiment, in which the projectile 10 itself contains magnetic particles, it is desirable that the melting point of the projectile or of that portion of the projectile containing tagging material, have a melting point lower than the temperature at which the magnetic particles decompose and begin to change in structure and position. This desire is easily fulfilled by the employment of ferrite tags in a projectile a portion of which is lead.

The use of tags in the primer is particularly important in creating an effective tagging system. This is the case because, even through certain aficionados reload their own ammunition, nonetheless the primer is rarely, if ever, a homemade item. Thus, magnetic tagging of the primer insures that at least a portion of the cartridge is tagged even in the case of home-loaded ammunition.

Because of the different construction of shotgun shell type ammunition, magnetic tagging of the projectile is not possible in the usual way, since the projectile typically comprises a large plurality of spherical steel shot. Tagging is nonetheless possible by employing a projectile, including spherical shot comprised of a metal more compatible with magnetic tag particle, such as lead. However, shotgun shell ammunition primers and main powder charge are still taggable in the mode described above. Such an embodiment, however, is of diminished practical importance because of the relative inability to retrieve an expended shotgun shell projectile.

In another embodiment of the present invention, a ferrite mixture is bonded to the casing 12 itself. The bonding of these ferrite particles 20*d* is also illustrated in FIG. 2.

The ferrite employed may be any ferrite material exhibiting a relatively sharp magnetization drop at its Curie temperature. For example, nickel zinc ferrite, $Ni_xZn_{1.0-x}Fe_2O_4$ and cobalt zinc ferrite, $Co_xZn_{1.0-x}Fe_2O_4$ where $0<x<1$, may be employed. Nickel-zinc ferrites exhibit Curie temperatures ranging from below 0° C. to approximately 595° C. Virtually any Curie temperature within this range is obtained by carefully varying the concentration of the nickel and zinc, with increases in nickel content and corresponding decreases in the zinc content resulting in the formation of ferrites with higher Curie temperatures. Likewise, cobalt-zinc ferrites which exhibit temperatures ranging from below 0° C. to approximately 520° C. may also advantageously be employed. With cobalt zinc ferrites increases in the concentration of cobalt with corresponding decreases in the zinc concentration also result in ferrites with increased Curie temperatures.

For magnetic tag particles disposed in either the main explosive powder charge, the primer explosive or bonded to the casing, the casing itself serves as a receptacle and a collector of tags. To determine the particular tag code employed, given an expended casing, scrapings are made from the internal casing wall. These scrapings may additionally be sorted by magnetic means to retrieve therefrom the magnetic portion of the scrapings. These scrapings are then controllably heated in a magnetic field and the decreases in magnetization are observed to determine the Curie temperatures present.

For the typical projectile 10 such as illustrated in FIG. 2, a somewhat different procedure is followed. In cases in which it is important to preserve the ballistic evidence as presented by the rifling marks on the expended projectile, it is important that the material to be analyzed from the projectile be gathered from the projectile in such a way that the rifling marks are not disturbed. This may be readily accomplished, for example, by drilling in the vicinity of the projectile axis. The magnetic particles are removed from the projectile or from drillings taken from the projectile by heating the material above the melting point of the projectile but below a temperature at which the structure and composition of the magnetic particles change. This is readily accomplished in a tagging system employing ferrite tag particles and a projectile comprising lead in part or in toto. After the magnetic tag particles are retrieved, they are analyzed in the same way as above for scrapings removed from the casing.

Magnetic tag identification for the casing is particularly important in investigations of those criminal activities involving the use of automatic or semi-automatic weapons since these weapons typically deposit expended cartridges at or near the crime scene.

From the above, it may be appreciated that the embodiments of the present invention provide a magnetic tag for cartridge ammunition rendering both the projectile and the casing subject to identification and the determination of relevant characteristics. Contrary to what might be expected, a sufficient magnetic tag particle residue is left behind in the casing following detonation to determine the Curie temperatures present and therefore the tag code employed. It can be further appreciated from the disclosure herein that the magnetic tag codes employed in the projectile and in the casing may be selected to be identical or at least similar in part to facilitate pairing of the projectile and the casing.

Thus the present invention provides a signficant aid to law enforcement agencies charged with investigation of shooting incidents.

While this invention has been described with reference to particular embodiments and examples, other modifications and variations will occur to those skilled in the art in view of the above teachings. Accordingly, it should be understood that the appended claims are intended to cover all such modifications and variations as full within the true spirit of the invention.

The invention claimed is:

1. In an improved ammunition cartridge of a type wherein a casing, with one open end, contains an explosive material, said casing being closed by the insertion in said open end, of a projectile, the improvement comprising:

magnetic particles disposed within said cartridge, said magnetic particles exhibiting at least one Curie temperature, whereby the cartridge may be identified by a tag code determined by the Curie temperatures exhibited.

2. In an improved ammunition cartridge of a type wherein a casing, with one open end, contains an explosive material, said casing being closed by the insertion in said open end, of a projectile, the improvement comprising:

magnetic particles disposed within said projectile, said magnetic particles exhibiting at least one Curie temperature in order to define a projectile tag code, whereby the projectile may be identified by the tag code specified by the Curie temperatures exhibited.

3. The cartridge of claim 2 in which the magnetic particles comprise ferrites.

4. The cartridge of claim 3 in which the melting point of said projectile is lower than the decomposition temperature of said ferrite particles.

5. The cartridge of claim 4 in which said projectile comprises lead.

6. The cartridge of claim 3 in which the ferrites are selected from the group consisting of nickel-zinc ferrite and cobalt-zinc ferrite.

7. In an improved ammunition cartridge of the type wherein a casing, with one open end, contains an explosive material, said casing being closed by the insertion, in said open end, of a projectile, and said casing having a primer disposed in the other end thereof, the improvement comprising:

magnetic particles disposed within said primer, said magnetic particles exhibiting at least one Curie temperature in order to define a primer tag code, whereby the casing may be identified by the tag code specified by the Curie temperatures exhibited.

8. The cartridge of claim 7 in which the magnetic particles are ferrites.

9. The cartridge of claim 8 in which the ferrites are selected from the group consisting of nickel-zinc ferrite and cobalt-zinc ferrite.

10. The cartridge of claim 7 in which additional magnetic particles are disposed in said projectile, said magnetic particles exhibiting at least one Curie temperature in order to define a projectile tag code.

11. The cartridge of claim 10 in which said primer tag code and said projectile tag code are the same.

12. The cartridge of claim 7 in which additional magnetic particles are disposed within said explosive material, said magnetic particles exhibiting at least one Curie temperature in order to define an explosive tag code.

13. In an improved ammunition cartridge of the type wherein a casing, with one open end, contains an explosive material, said casing being closed by the insertion in said open end, of a projectile, the improvement comprising:

magnetic particles disposed within said explosive material, said magnetic particles exhibiting at least one Curie temperature in order to define an explosive tag code, whereby the explosives may be identified by the explosive tag code specified by the Curie temperatures exhibited.

14. The cartridge of claim 13 in which additional magnetic particles are disposed within said projectile, said magnetic particles exhibiting at least one Curie temperature in order to define a projectile tag code.

15. The cartridge of claim 13 in which the magnetic particles comprise ferrite.

16. In an improved ammunition cartridge of the type wherein a casing, with one open end, contains an explosive material, said casing being closed by the insertion, in said open end, of a projectile, the improvement comprising:

magnetic particles fixably bonded to said casing, said magnetic particles exhibiting at least one Curie temperature in order to define a casing tag code, whereby the casing may be identified by the casing tag code specified by the Curie code temperatures exhibited.

17. The cartridge of claim 16 in which the magnetic particles comprise ferrite.

* * * * *